US011122368B1

(12) United States Patent
Little

(10) Patent No.: US 11,122,368 B1
(45) Date of Patent: Sep. 14, 2021

(54) HEADPHONE/MP3 PLAYER ASSEMBLY

(71) Applicant: Mary Little, Scooba, MS (US)

(72) Inventor: Mary Little, Scooba, MS (US)

( * ) Notice: Subject to any disclaimer, the term of this patent is extended or adjusted under 35 U.S.C. 154(b) by 0 days.

(21) Appl. No.: 16/796,432

(22) Filed: Feb. 20, 2020

(51) Int. Cl.
*H04R 25/00* (2006.01)
*H04R 5/033* (2006.01)
*H04R 1/10* (2006.01)

(52) U.S. Cl.
CPC ..... *H04R 5/0335* (2013.01); *H04R 1/1008* (2013.01); *H04R 1/1025* (2013.01); *H04R 1/1041* (2013.01)

(58) Field of Classification Search
CPC .. H04R 5/0355; H04R 1/1008; H04R 1/1025; H04R 1/1041
USPC ..... 381/370
See application file for complete search history.

(56) References Cited

U.S. PATENT DOCUMENTS 7,251,335 B1 7/2007 Chen
8,275,143 B2 9/2012 Johnson
8,652,062 B1 2/2014 Holder
D721,053 S 1/2015 Fujioka
2007/0053544 A1 3/2007 Jhao
2007/0165875 A1 7/2007 Rezvani
2009/0198355 A1 8/2009 Powell
2015/0365760 A1* 12/2015 Jiang ..... H04R 1/1025 381/71.6

* cited by examiner

*Primary Examiner* — Phylesha Dabney

(57) ABSTRACT

A headphone/mp3 player assembly for listening to audio from a plurality of audio sources includes a pair of headphones that can be worn on a listeners' head. A control circuit is coupled to the headphones and a media player is integrated into the headphones. The media player is electrically coupled to the control circuit. A radio tuner is coupled to the headphones for receiving FM and AM radio signals and the radio tuner is electrically coupled to the control circuit. A transceiver is coupled to the headphones and the transceiver is electrically coupled to the control circuit. The transceiver is configured can be placed in electrical communication with an electronic audio source for receiving an audio signal therefrom. A pair of speakers is each of the speakers is coupled to a respective one of the headphones and each of the speakers is electrically coupled to the control circuit.

4 Claims, 5 Drawing Sheets

HEADPHONE/MP3 PLAYER ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to player devices and more particularly pertains to a new player device for listening to audio from a plurality of audio sources.

BRIEF SUMMARY OF THE INVENTION

An embodiment of the disclosure meets the needs presented above by generally comprising a pair of headphones that can be worn on a listeners' head. A control circuit is coupled to the headphones and a media player is integrated into the headphones. The media player is electrically coupled to the control circuit. A radio tuner is coupled to the headphones for receiving FM and AM radio signals and the radio tuner is electrically coupled to the control circuit. A transceiver is coupled to the headphones and the transceiver is electrically coupled to the control circuit. The transceiver is configured can be placed in electrical communication with an electronic audio source for receiving an audio signal therefrom. A pair of speakers is each of the speakers is coupled to a respective one of the headphones and each of the speakers is electrically coupled to the control circuit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
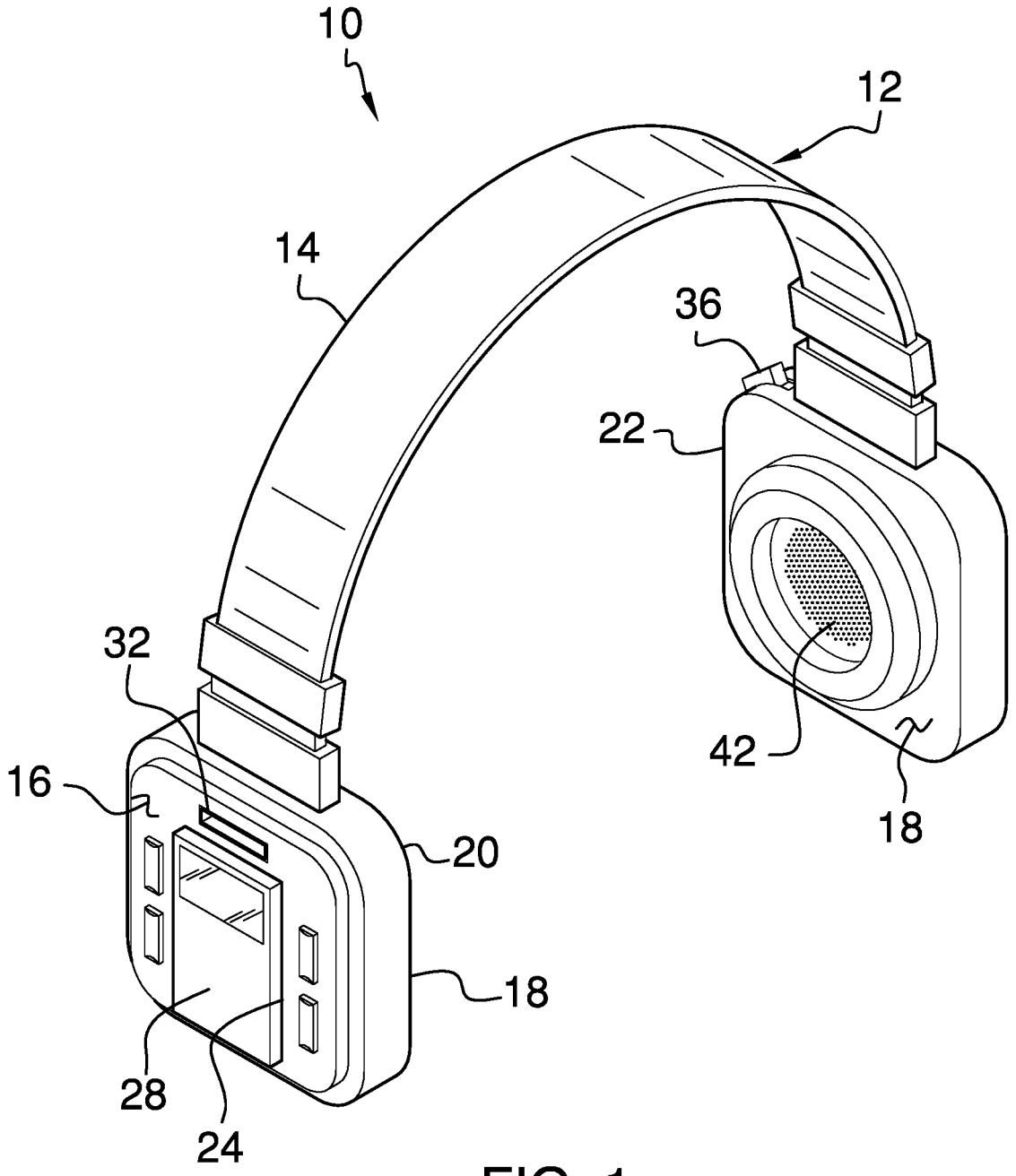
FIG. 1 is a perspective view of a headphone/mp3 player assembly according to an embodiment of the disclosure.
Figure 3:
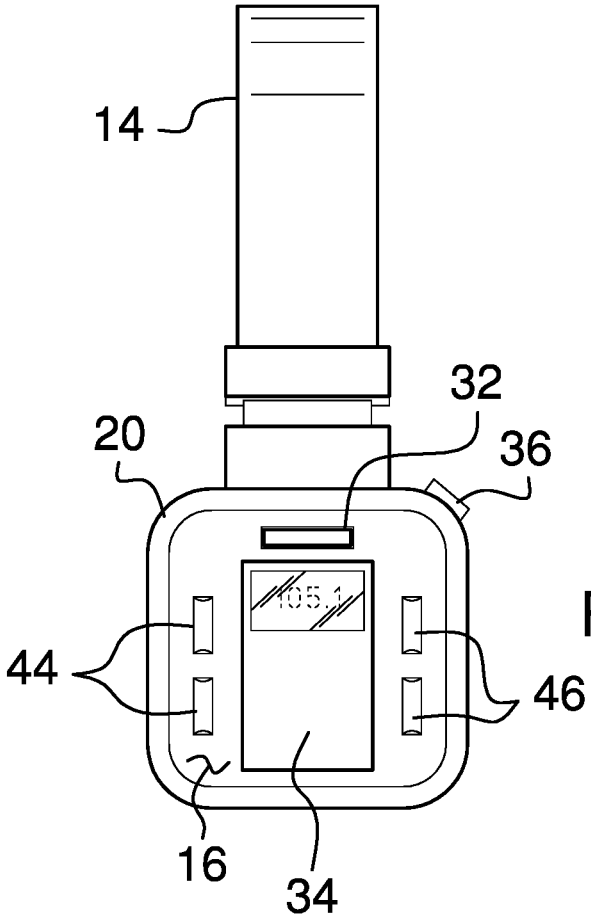
FIG. 3 is a right side view of an embodiment of the disclosure.
Figure 2:
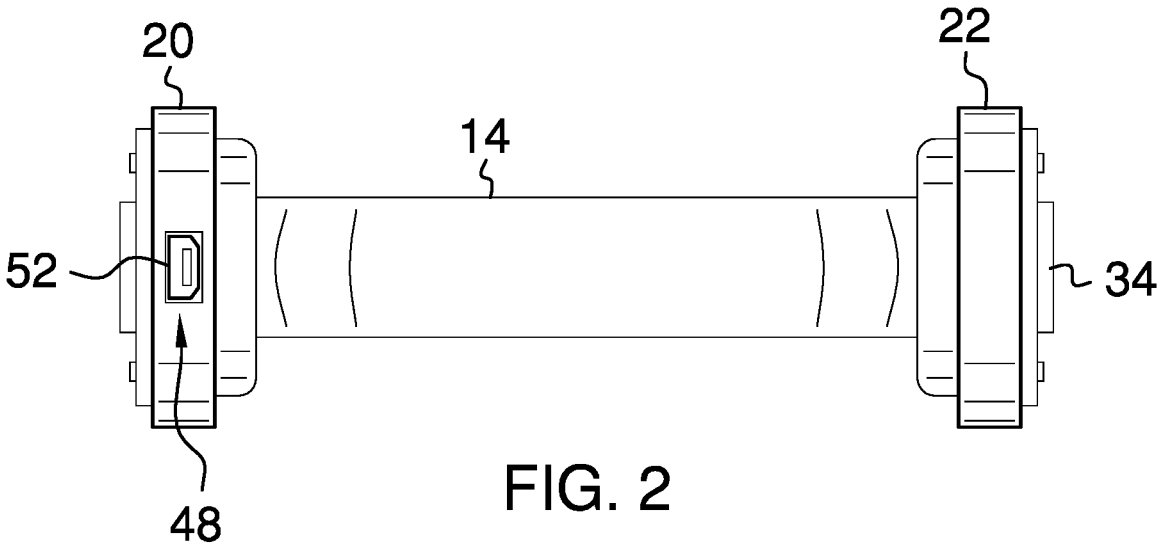
FIG. 2 is a bottom view of an embodiment of the disclosure.
Figure 4:
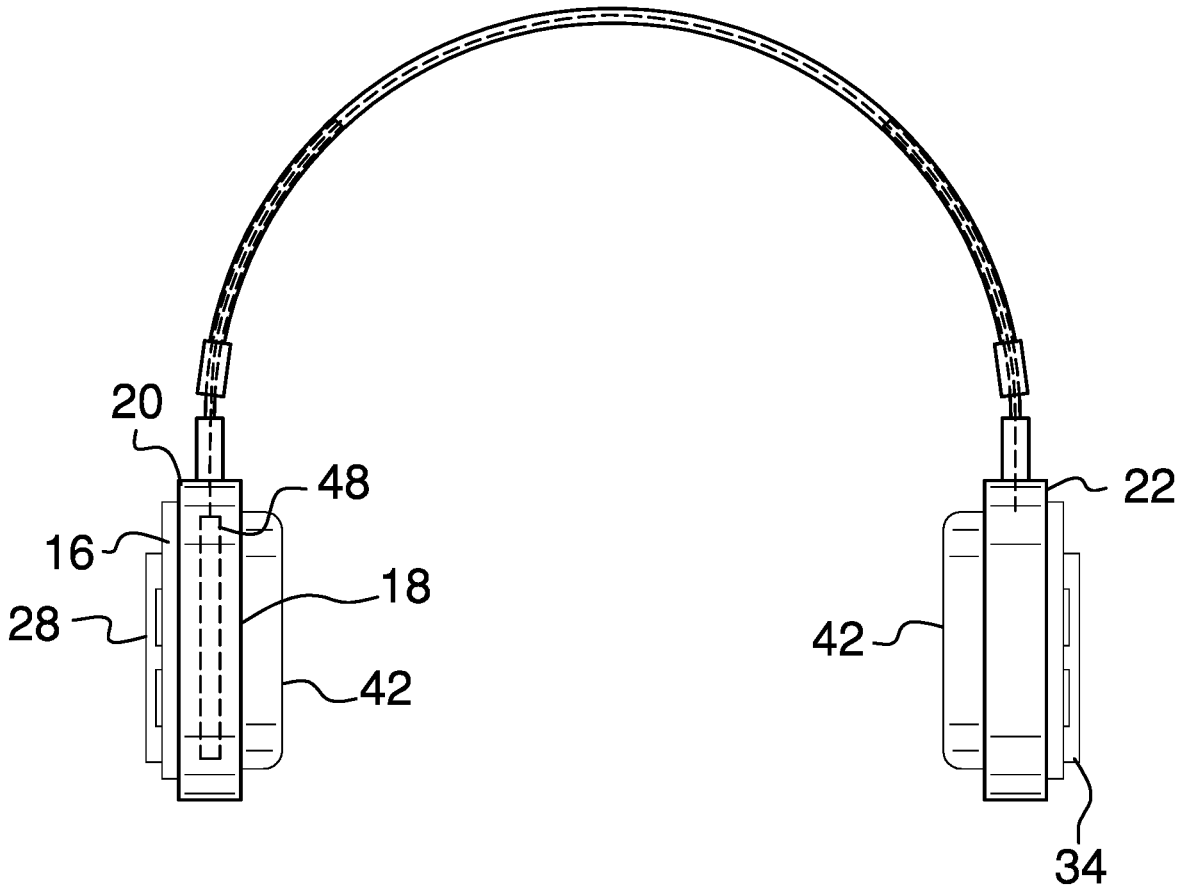
FIG. 4 is a front phantom view of an embodiment of the disclosure.
Figure 5:
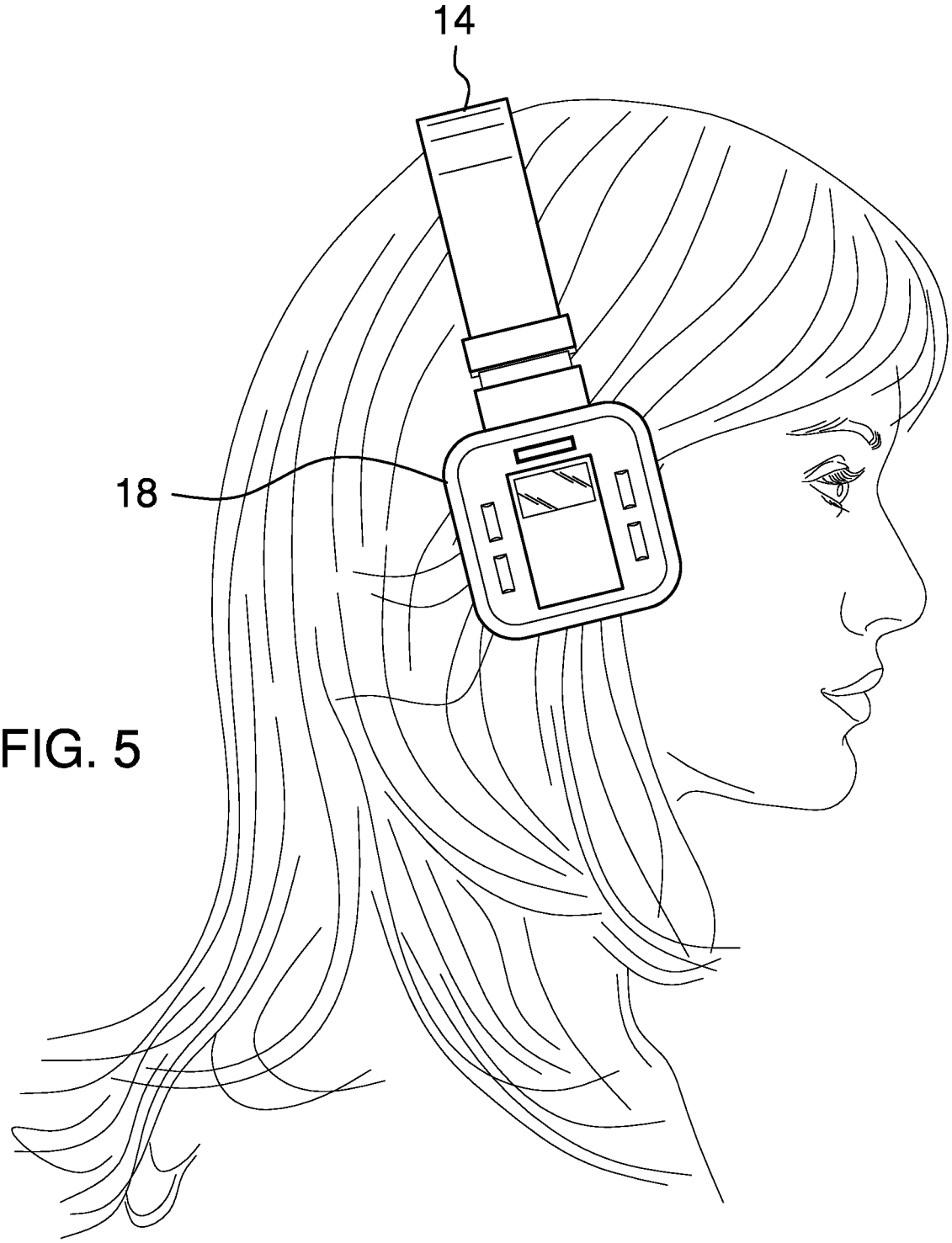
FIG. 5 is a perspective in-use view of an embodiment of the disclosure.
Figure 6:
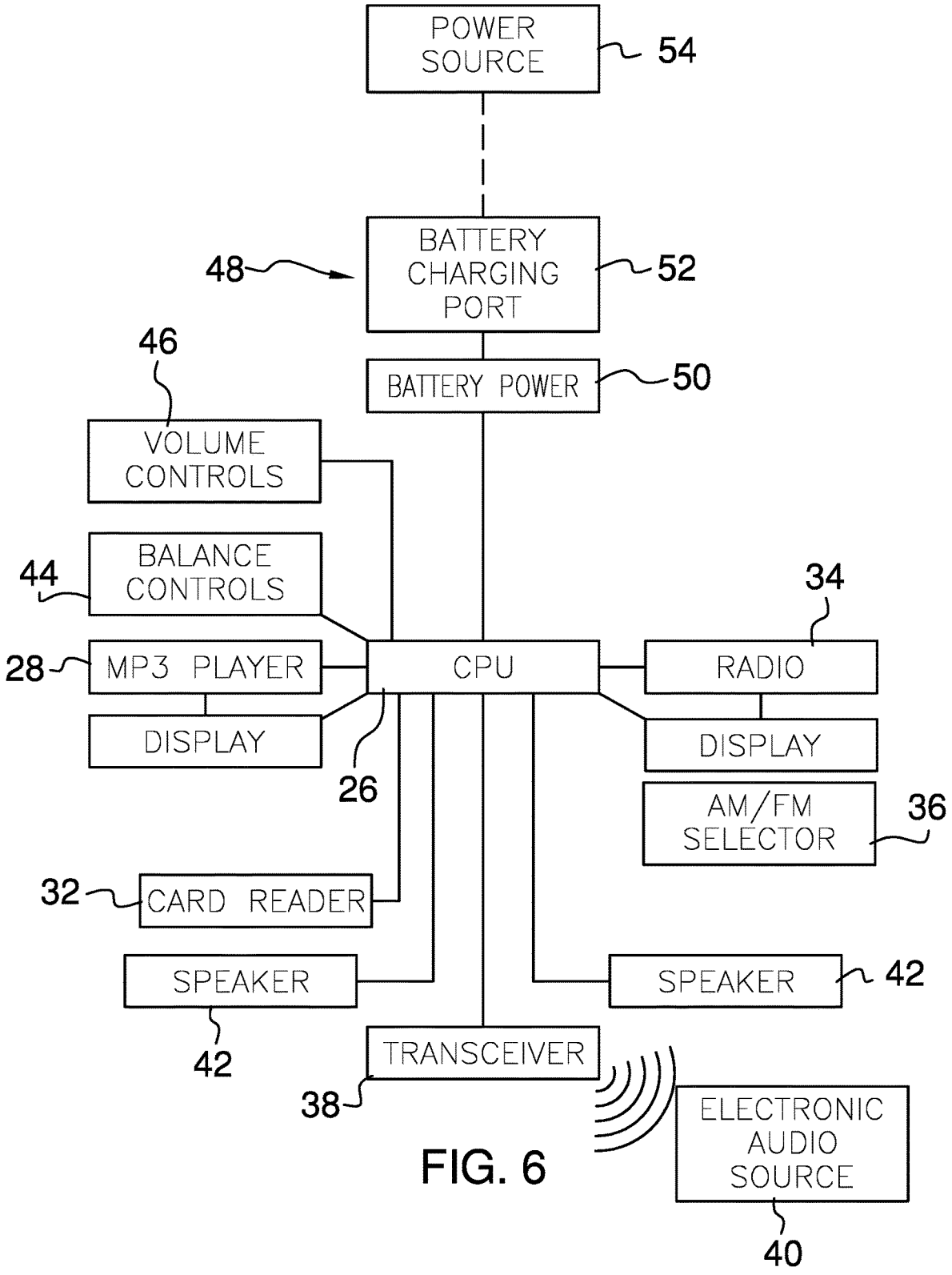
FIG. 6 is a schematic view of an embodiment of the disclosure.

With reference now to the drawings, and in particular to FIGS. 1 through 6 thereof, a new player device embodying the principles and concepts of an embodiment of the disclosure and generally designated by the reference numeral 10 will be described.

As best illustrated in FIGS. 1 through 6, the headphone/mp3 player assembly 10 generally comprises a pair of headphones 12 that can be worn on a listeners' head. The pair of headphones 12 includes a head strap 14 extending therebetween for extending over the listener's head. Each of the headphones 12 has a first surface 16 and a second surface 18 and the pair of headphones 12 includes a first headphone 20 and a second headphone 22. The first surface 16 of the first headphone 20 has a well 24 extending toward the second surface 18 of the first headphone 20.

A control circuit 26 is coupled to the headphones 12 and a media player 28 is integrated into the headphones 12. The media player 28 is electrically coupled to the control circuit 26 and the media player 28 includes an electronic memory 30 for storing data comprising audio files. The media player 28 is positioned in the well 24 in the first headphone 20 and the media player 28 may comprise an MP3 player or the like. Additionally, the media player 28 may include a display, such as an LCD or the like, for displaying selected tracks stored in the electronic memory 30 and other operational parameters of the media player 28.

A memory card reader 32 extends into the first surface 16 of the first headphone 20 and the memory card reader 32 is electrically coupled to the control circuit 26. The memory card reader 32 insertably receives a memory card for transferring data between the memory card and the electronic memory 30 in the media player 28. The memory card reader 32 may be an SD card reader or any other conventional type of memory card reader 32.

A radio tuner 34 is coupled to the second headphone 22 for receiving FM and AM radio signals. The radio tuner 34 is electrically coupled to the control circuit 26 and the radio tuner 34 may be an electronic radio tuner of any conventional design. A radio selection switch 36 is slidably coupled to the second headphone 22 and the radio selection switch 36 is electrically coupled to the radio tuner 34 for selecting FM or AM radio signals. The radio tuner 34 may include a display, such as an LCD or the like, for displaying a tuning of the radio station and other operational parameter of the radio tuner 34.

A transceiver 38 is coupled to the headphones 12 and the transceiver 38 is electrically coupled to the control circuit 26. The transceiver 38 can be placed in electrical communication with an electronic audio source 40 for receiving an audio signal therefrom. The transceiver 38 may be a radio frequency transceiver 38 of the like and the transceiver 38 may employ a WPAN signal and Bluetooth communication protocols. Additionally, the electronic audio source 40 may be a Smartphone or other similar data storage device.

A pair of speakers 42 is each coupled to a respective one of the headphones 12 for emitting audible sounds outwardly therefrom. Each of the speakers 42 is electrically coupled to the control circuit 26. A pair of balance buttons 44 is each movably coupled to a respective one of the headphones 12. Each of the balance buttons 44 is electrically coupled to the control circuit 26 for adjusting a balance of the speakers 42. A pair of volume buttons 46 is each movably coupled to a respective one of the headphones 12. Each of the volume buttons 46 is electrically coupled to the control circuit 26 for adjusting a volume of the speakers 42 between a minimum volume and a maximum volume.

A power supply 48 is coupled to the headphones 12 and the power supply 48 is electrically coupled to the control circuit 26. The power supply 48 comprises at least one battery 50 that is positioned within a respective one of the headphones 12. The at least one battery 50 is electrically coupled to the control circuit 26. The power supply 48 additionally includes a charge port 52 that extends into a respective one of the headphones 12. The charge port 52 is electrically coupled to the at least one battery 50 and the charge port 52 can be electrically coupled to a power source 54, such as battery 50 charger or the like, for charging the at least one battery 50.

In use, the headphones 12 are worn on the listener's head for listening to music or other audible sounds. The radio tuner 34 can be turned on to listen to broadcast radio stations. Alternatively, the media player 28 can be turned on the listen to audio that is stored in the media player 28. A memory card can be inserted into the memory card reader 32 for transferring data between the media player 28 and the electronic device. Thus, audio that is stored in the media player 28 can be downloaded into the electronic device or vice-verse. The volume buttons 46 are manipulated to adjust the volume of the speakers 42 and the balance buttons 44 can be manipulated to adjust the balance of the speakers 42. Additionally, the transceiver 38 can be synched with the electronic audio source 40 for receiving an audio signal therefrom.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A headphone/mp3 player assembly being configured to play pre-recorded music, said assembly comprising:

a pair of headphones being worn on a listeners' head, said pair of headphones including a head strap extending therebetween for extending over the user's head, each of said headphones having a first surface and a second surface, said pair of headphones including a first headphone and a second headphone, said first surface of said first headphone having a well extending toward said second surface of said first headphone;

a control circuit being coupled to said headphones;

a media player being integrated into said headphones, said media player being electrically coupled to said control circuit, said media player being positioned in said well in said first headphone;

a radio tuner being coupled to said headphones wherein said radio tuner is configured to receive FM and AM radio signals, said radio tuner being electrically coupled to said control circuit;

a transceiver being coupled to said headphones, said transceiver being electrically coupled to said control circuit, said transceiver being configured to be in electrical communication with an electronic audio source for receiving an audio signal therefrom;

a pair of speakers, each of said speakers being coupled to a respective one of said headphones wherein each of said speakers is configured to emit audible sounds outwardly therefrom, each of said speakers being electrically coupled to said control circuit;

a pair of balance buttons, each of said balance buttons being movably coupled to a respective one of said headphones, each of said balance buttons being electrically coupled to said control circuit for adjusting a balance of said speakers; and a pair of volume buttons, each of said volume buttons being movably coupled to a respective one of said headphones, each of said volume buttons being electrically coupled to said control circuit for adjusting a volume of said speakers between a minimum volume and a maximum volume.

2. The assembly according to claim 1, further comprising a memory card reader extending into said first surface of said first headphone, said memory card reader being electrically coupled to said control circuit, said memory card reader insertably receiving a memory card for transferring data between the memory card and said electronic memory in said media player.

3. The assembly according to claim 1, further comprising a power supply being coupled to said headphones, said power supply being electrically coupled to said control circuit, said power supply comprising:

at least one battery being positioned within a respective one of said headphones, said at least one battery being electrically coupled to said control circuit; and a charge port extending into a respective one of said headphones, said charge port being electrically coupled to said at least one battery, said charge port being configured to be electrically coupled to a power source for charging said at least one battery.

4. A headphone/mp3 player assembly being configured to play pre-recorded music, said assembly comprising:

a pair of headphones being worn on a listeners' head, said pair of headphones including a head strap extending therebetween for extending over the user's head, each of said headphones having a first surface and a second surface, said pair of headphones including a first headphone and a second headphone, said first surface of said first headphone having a well extending toward said second surface of said first headphone;

a control circuit being coupled to said headphones;

a media player being integrated into said headphones, said media player being electrically coupled to said control circuit, said media player including an electronic memory for storing data comprising audio files, said media player being positioned in said well in said first headphone;

a memory card reader extending into said first surface of said first headphone, said memory card reader being electrically coupled to said control circuit, said memory card reader insertably receiving a memory card for transferring data between the memory card and said electronic memory in said media player;

a radio tuner being coupled to said second headphone wherein said radio tuner is configured to receive FM and AM radio signals, said radio tuner being electrically coupled to said control circuit;

a radio selection switch being slidably coupled to said second headphone, said radio selection switch being electrically coupled to said radio tuner for selecting FM or AM radio signals;

a transceiver being coupled to said headphones, said transceiver being electrically coupled to said control circuit, said transceiver being configured to be in electrical communication with an electronic audio source for receiving an audio signal therefrom;

a pair of speakers, each of said speakers being coupled to a respective one of said headphones wherein each of said speakers is configured to emit audible sounds outwardly therefrom, each of said speakers being electrically coupled to said control circuit;

a pair of balance buttons, each of said balance buttons being movably coupled to a respective one of said headphones, each of said balance buttons being electrically coupled to said control circuit for adjusting a balance of said speakers;

a pair of volume buttons, each of said volume buttons being movably coupled to a respective one of said headphones, each of said volume buttons being electrically coupled to said control circuit for adjusting a volume of said speakers between a minimum volume and a maximum volume; and a power supply being coupled to said headphones, said power supply being electrically coupled to said control circuit, said power supply comprising:

at least one battery being positioned within a respective one of said headphones, said at least one battery being electrically coupled to said control circuit; and a charge port extending into a respective one of said headphones, said charge port being electrically coupled to said at least one battery, said charge port being configured to be electrically coupled to a power source for charging said at least one battery.

* * * * *